US009488181B2

(12) United States Patent
Parodi et al.

(10) Patent No.: US 9,488,181 B2
(45) Date of Patent: Nov. 8, 2016

(54) FAN MODULE FOR A HEAT EXCHANGER

(71) Applicant: Johnson Electric S.A., Murten (CH)

(72) Inventors: Davide Parodi, Asti (IT); Piergiorgio Innocenti, Asti (IT)

(73) Assignee: JOHNSON ELECTRIC S.A., Murten (CH)

( * ) Notice: Subject to any disclaimer, the term of this patent is extended or adjusted under 35 U.S.C. 154(b) by 611 days.

(21) Appl. No.: 14/018,025

(22) Filed: Sep. 4, 2013

(65) Prior Publication Data

US 2014/0064941 A1 Mar. 6, 2014

(30) Foreign Application Priority Data

Sep. 5, 2012 (IT) ..... TO2012A0765

(51) Int. Cl.

| | |
|---|---|
| ***F01D 25/08*** | (2006.01) |
| ***F04D 27/00*** | (2006.01) |
| ***F04D 19/00*** | (2006.01) |
| ***F04D 25/08*** | (2006.01) |
| ***F04D 29/58*** | (2006.01) |

(52) U.S. Cl.

CPC ..... *F04D 27/00* (2013.01); *F04D 19/002* (2013.01); *F04D 25/082* (2013.01); *F04D 29/5806* (2013.01); *F04D 29/5813* (2013.01)

(58) Field of Classification Search

CPC .... F04D 19/002; F04D 25/08; F04D 25/082; F04D 27/00; F04D 29/5806; F04D 29/5813; G06F 1/20; G06F 1/133385; H05K 7/20918; H05K 7/20163; H05K 7/20136

USPC ..... 415/177; 416/181; 361/679.47, 679.48, 361/695, 696, 697

See application file for complete search history.

(56) References Cited

U.S. PATENT DOCUMENTS

| | | | | |
|---|---|---|---|---|
| 5,944,497 | A * | 8/1999 | Kershaw | F04D 25/082 417/368 |
| 6,384,494 | B1 * | 5/2002 | Avidano | H02K 9/06 310/58 |
| 8,016,574 | B2 * | 9/2011 | De Filippis | F04D 25/082 310/59 |
| 8,899,930 | B2 * | 12/2014 | Innocenti | B60K 11/02 415/143 |
| 2002/0187059 | A1 * | 12/2002 | Gold | F04D 25/082 417/366 |
| 2004/0223845 | A1 | 11/2004 | Caplan et al. | |
| 2006/0022529 | A1 * | 2/2006 | De Filippis | F04D 25/082 310/58 |
| 2007/0152519 | A1 * | 7/2007 | Jarrah | F04D 25/082 310/58 |
| 2008/0030087 | A1 * | 2/2008 | De Filippis | F04D 25/082 310/58 |
| 2008/0122322 | A1 * | 5/2008 | Izumi | F04D 25/0613 310/67 R |
| 2010/0054968 | A1 * | 3/2010 | Fleischmann | F04D 25/082 417/366 |

* cited by examiner

*Primary Examiner* — Jason Shanske
*Assistant Examiner* — Matthew T Largi
(74) *Attorney, Agent, or Firm* — Muncy, Geissler, Olds & Lowe, P.C.

(57) ABSTRACT

A fan module (1) includes a support structure (2), a motor (6), and an impeller (12). The support structure (2) includes an outer frame (3), an inner seat (5), and spokes (4) connecting the outer frame (3) to the inner seat (5). The motor (6) includes a stator (7) fixed to the inner seat (5), a rotor (8) rotatably mounted to the stator (7), a heat sink (11) at one end of the stator (7), and a control circuit (9) in thermal contact with the heat sink (11). The impeller (12) includes a hub (13) having a front wall (13*a*), a side wall (13*b*) spaced from the front wall (13*a*), and inner vanes (17) extending from the side wall (13*b*) and connected to the front wall (13*a*). Top ends of two adjacent inner vanes (17) are spaced from each other with an intake opening (17*c*) defined therebetween.

19 Claims, 8 Drawing Sheets

FAN MODULE FOR A HEAT EXCHANGER

CROSS REFERENCE TO RELATED APPLICATIONS

This non-provisional patent application claims priority under 35 U.S.C. §119(a) from Patent Application No. TO2012A000765 filed in Italy on 5 Sep. 2012.

FIELD OF THE INVENTION

This invention relates to a fan module and in particular to a cooling fan module for a heat exchanger such as a radiator of a motor vehicle.

BACKGROUND OF THE INVENTION

A conventional cooling fan module for a radiator of a motor vehicle disclosed by EP1050682A2 includes a fixed support structure, a DC electric motor, particularly a brushless motor, and an impeller. The support structure includes an outer frame, an annular inner seat, and a plurality of spokes connecting the annular inner seat to the outer frame. The electric motor includes a stator fixed to the annular inner seat of the support structure, a rotor mounted to the stator, and a circuit means, the components of which are in thermal contact with an essentially plate-like heat sink which extends transversely with respect to the axis of the motor at a first end of the stator. The impeller is fixed to the rotor of the motor at a second end of the stator and having a hollow hub from which a plurality of outer blades extends. The hub has an annular front wall intended to the struck by the air flow caused by the fan and a side wall extending from a circumferential edge of the front wall. The side wall surrounds the motor defining an annular space with respect thereto. The hub is further provided with a plurality of inner ventilation vanes which extend from the inner surface thereof and are adapted to generate in operation, within the annular space, a flow of cooling air which contacts the motor and the heat sink.

In this conventional fan module, a flow of air is drawn in by the rotating hub and arrives at the rear end of the motor where the heat sink locates. This flow then passes through the electric motor, in the direction from its rear end towards its front or anterior end, thereby cooling the heat sink associated with the internal electronic control circuits, as well as the motor itself. At the front end of the motor, this air flow is diverted radially outwards, and enters the annular space formed between the side wall of the fan hub and the motor. In this space, the air flow is propagated from the front end of the motor towards the rear end thereof, and is discharged outwards at the outlet end of the impeller hub.

One object of the present invention is to provide a fan module which is appropriately improved, particularly in order to provide more effective cooling of the heat sink mounted at the rear end of the fan motor.

SUMMARY OF THE INVENTION

This and other objects are achieved according to the invention with a fan module including a fixed support structure, an electric motor fixed to the support structure, and an impeller driven by the motor. The support structure includes an outer frame, an inner seat and a plurality of spokes connecting the outer frame to the inner seat. The electric motor includes a stator fixed to the inner seat of the support structure, a rotor rotatably mounted to the stator, a heat sink arranged at a first end of the stator and a motor control circuit having components in thermal contact with the heat sink. The impeller includes a hub and a plurality of outer vanes extending from an outer periphery of the hub. The hub has a front wall, a side wall surrounding and spaced from a circumferential edge of the front wall, and a plurality of inner vanes extending from an inner surface of the side wall and having top ends connected to the front wall. The plurality of inner vanes are spaced from each other angularly with an intake opening defined between the top ends of two adjacent inner vanes.

In some embodiments, each inner vane has an inlet portion adjacent to the front wall of the hub and an outlet portion extending essentially radially and axially, the inlet portion is inclined forwardly in a direction of rotation of the impeller, and has a circumferential deviation from and along an axial prolongation of the outlet portion.

This and other objects are achieved with an another fan module including a fixed support structure having an outer frame, an inner seat, and a plurality of spokes connecting the outer frame to the inner seat, an electric motor having a stator fixed to the support structure and a rotor mounted to the stator, and an impeller fixed to the rotor of the motor. The impeller includes a hub and a plurality of outer vanes extending from an outer periphery of the hub. The hub has a front wall defining a plurality of intake openings, a side wall surrounding the motor with a space defined therebetween, and a plurality of inner vanes extending inwardly from an inner surface of the side wall. Each inner vane has an inlet portion adjacent to the front wall and an outlet portion extending essentially radially and axially from the inlet portion. The inlet portion is inclined forwardly in a direction of rotation of the impeller, and has a circumferential deviation from and increasing along an axial prolongation of the outlet portion.

In some embodiments, the inner seat of the support structure has an inner deflection surface facing an end edge of the side wall of the hub of the impeller, and at least a portion of the inner deflection surface is inclined with respect to the rotation axis A-A of the motor. The at least a portion of the inner deflection surface is preferably curved and concave in cross section. The inner deflection surface is adapted to divert, at least in part, in a centripetal radial direction towards the heat sink, the axial air flow exiting from the annular space.

In some embodiments, a plurality of essentially radial ribs extend from the inner deflection surface of the inner seat of the support structure.

In some embodiments, on the side facing the side wall of the hub of the impeller, the inner seat of the support structure has a mouth opening defined by the inner deflection surface and having a diameter greater than or substantially equal to an outlet diameter of the side wall.

In some embodiments, the inlet portion of each inner ventilation vane is arcuate and has a convex outer surface, facing the front wall of the hub of the fan, and an essentially concave inner surface, facing in the opposite direction.

In some embodiments, the inlet portion of each inner ventilation vane has, when seen in the radial direction, a cross section shaped like a wing profile.

In some embodiments, each inner ventilation vane has a free longitudinal edge on a side opposite to the side wall, and the free longitudinal edge is arcuate and convex.

BRIEF DESCRIPTION OF THE DRAWINGS

Preferred embodiment of the invention will now be described, by way of example only, with reference to the drawings, in which identical or related structures, elements or parts may be labeled with the same reference numerals throughout the Figures. Dimensions of components and features shown in the Figures. are generally chosen for convenience and clarity of presentation and are not necessarily shown to scale.

DETAILED DESCRIPTION OF THE PREFERRED EMBODIMENTS

Figure 1:
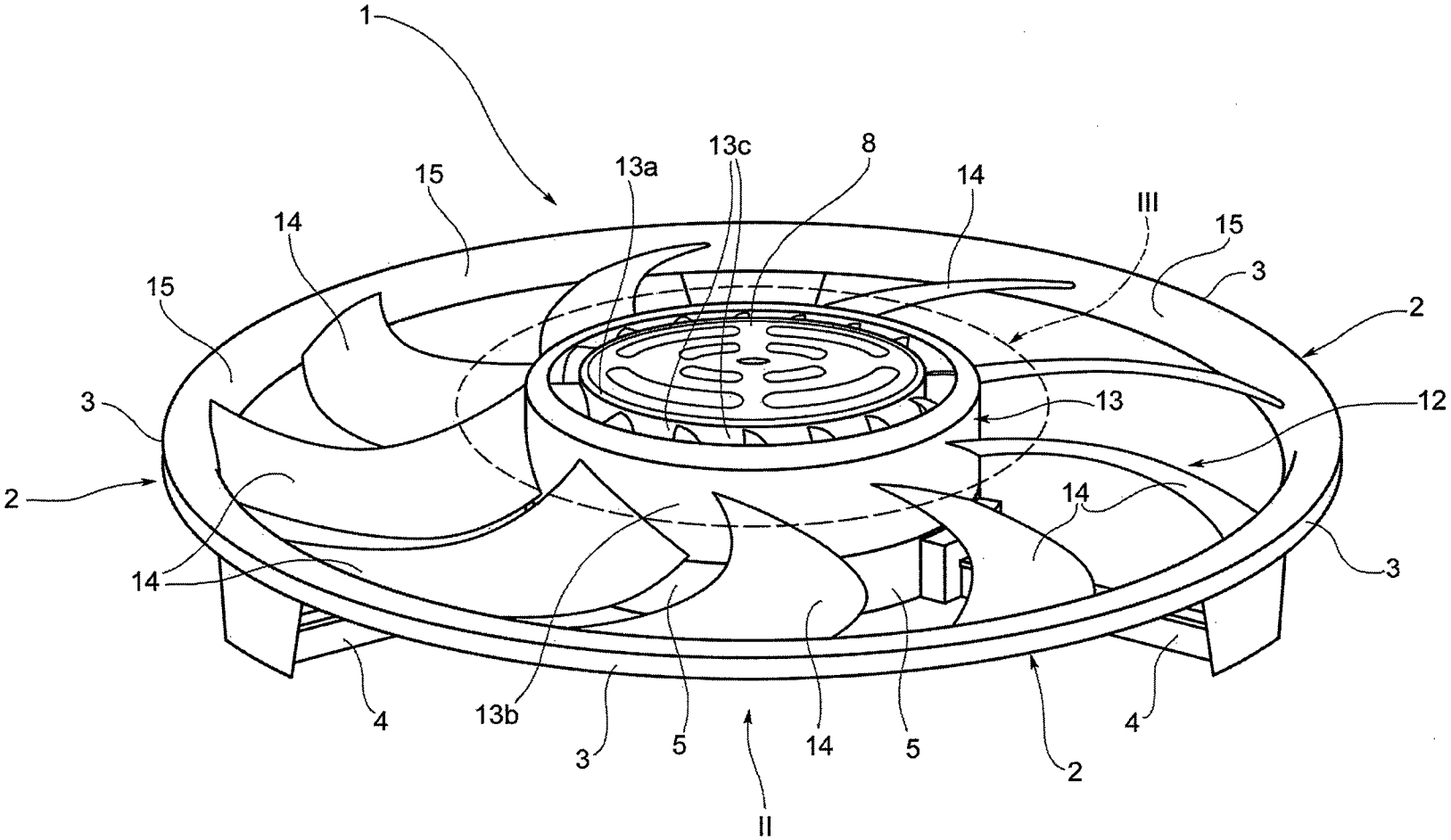
FIG. 1 is a perspective front view of a fan module according to an exemplary embodiment of the invention.
Figure 2:
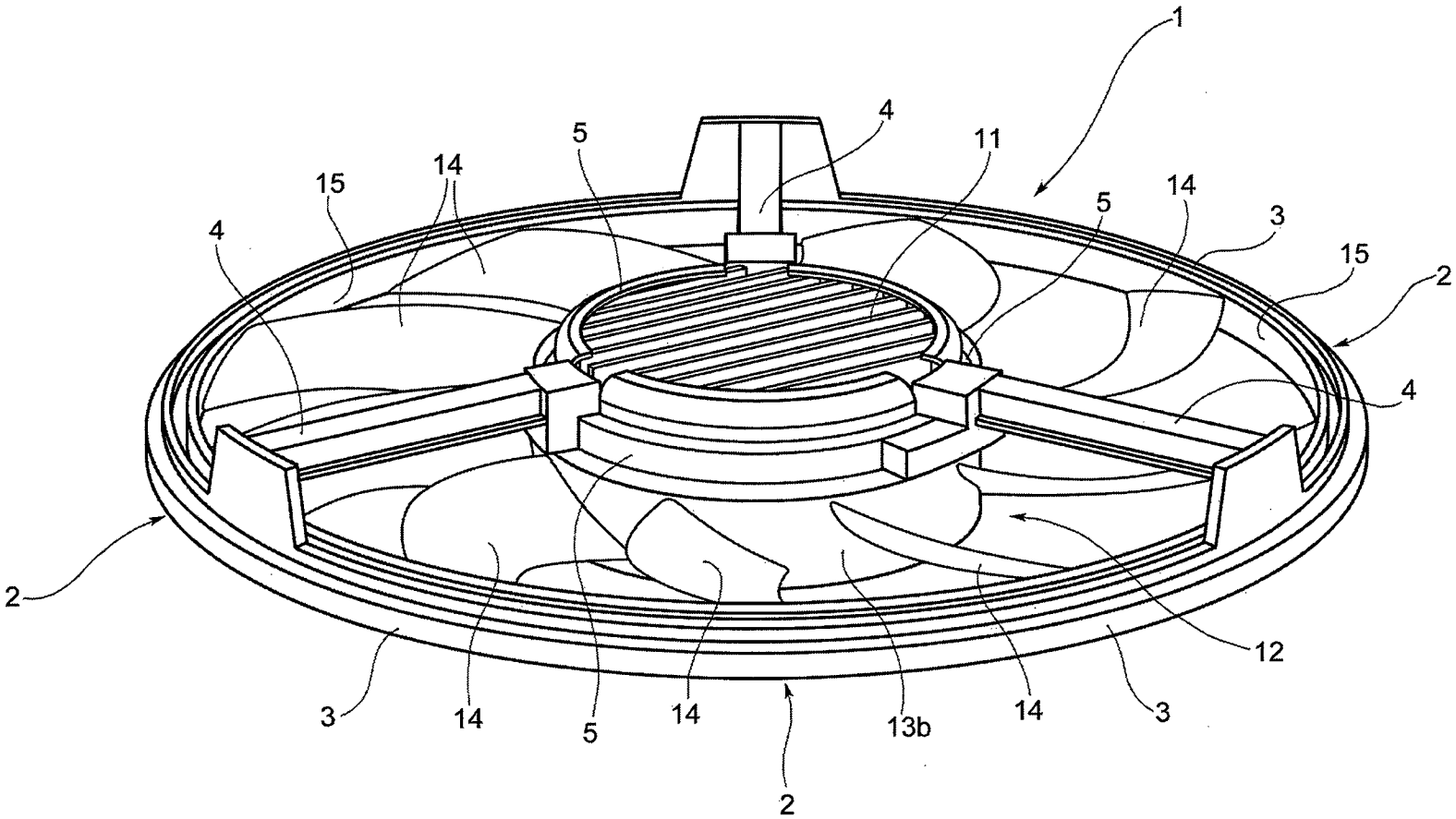
FIG. 2 is a perspective rear view of the fan module of FIG. 1.

In the drawings, and particularly in FIGS. 1 and 2, the number 1 indicates the whole of a fan module according to the present invention, which can be used, in particular, for cooling a heat exchanger, such as a radiator of a motor vehicle.

The fan module 1 includes a support structure, indicated as a whole by 2, which is fixed in operation. The support structure 2 includes an outer frame 3, which, in the embodiment illustrated by way of example, is ring-shaped, and is connected by a plurality of spokes 4 (FIG. 2) to an annular inner seat 5.

Figure 7:
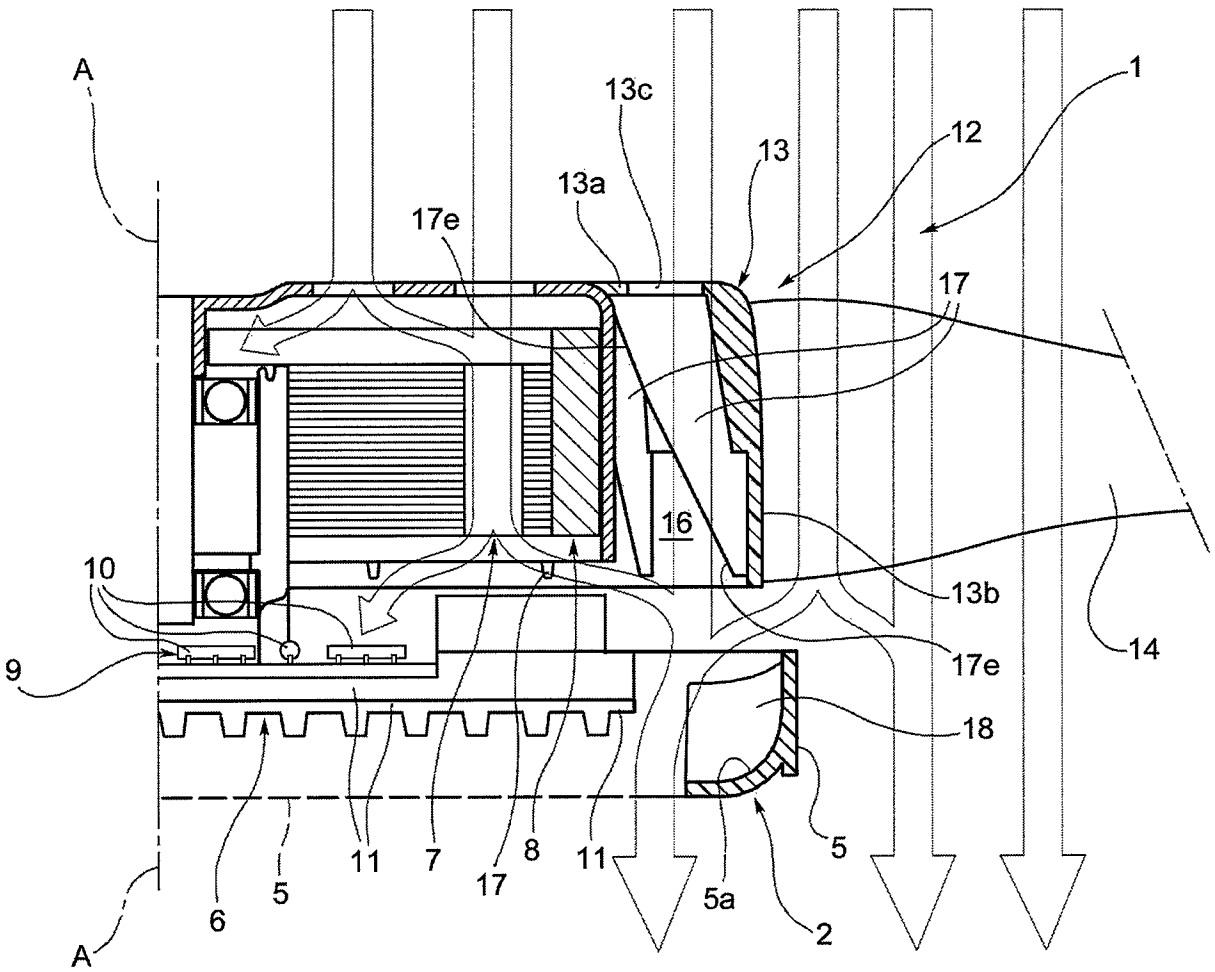
FIG. 7 is a partial view in axial section of the fan module of FIG. 1.

As can be seen more clearly in FIG. 7, the fan module 1 includes a DC electric motor, particularly a brushless motor, indicated as a whole by 6. This motor 6 includes a stator 7, fixed in a known way to the inner seat 5 of the support structure 2, and a rotor 8 which is rotatably mounted to the stator 7.

Figure 8:
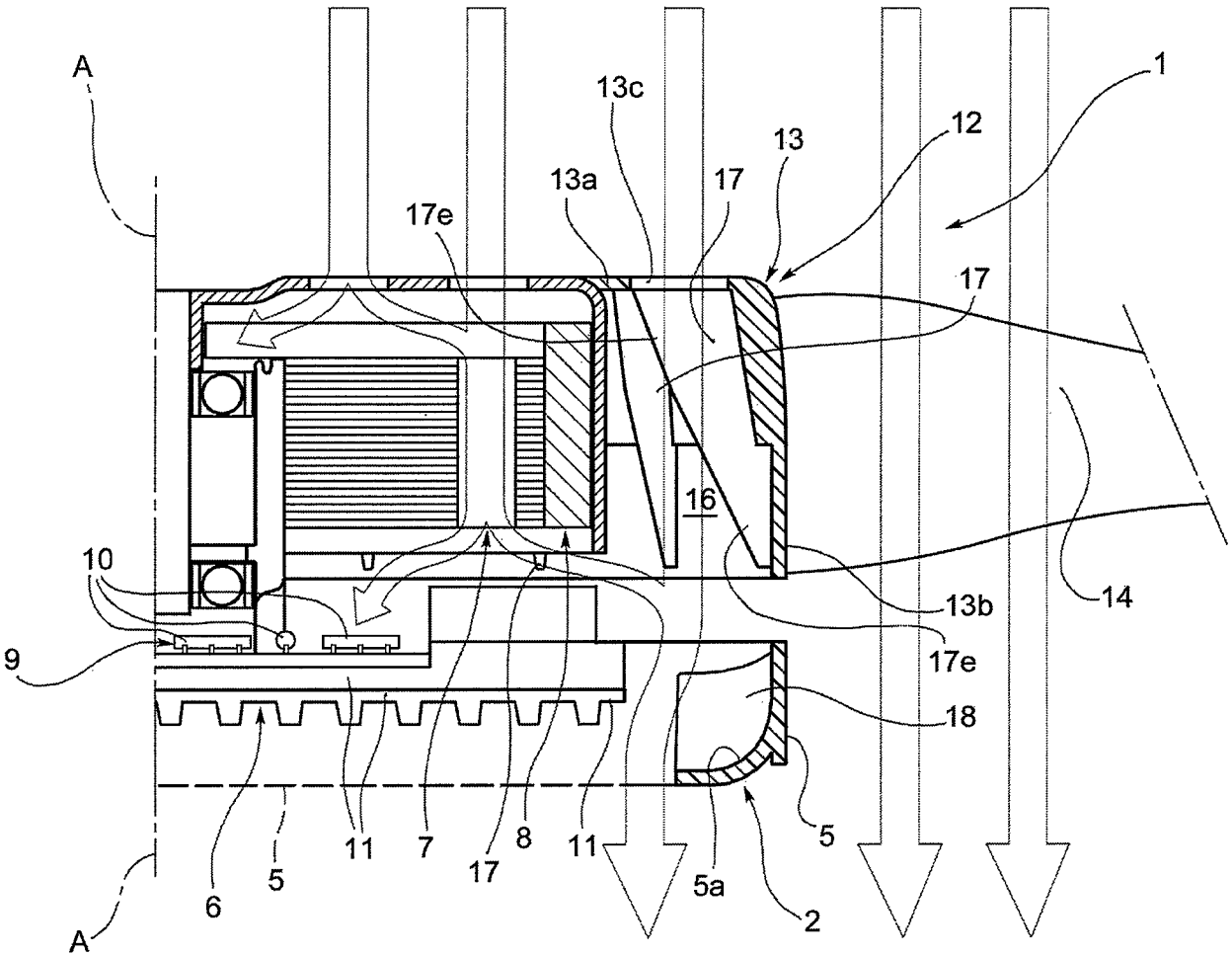
FIG. 8 is a view similar to that presented in FIG. 7, and shows a fan module according to another embodiment.

The electric motor 6 is associated with an electronic control circuit 9, the components of which, indicated generically by 10 in FIGS. 7 and 8, are in thermal contact with a plate-like heat sink 11 which extends transversely with respect to a rotation axis A-A of the motor 6 near the rear end of the stator 7.

The fan module 1 further includes an impeller indicated as a whole by 12, fixed to the rotor 8 of the electric motor 6 at the end of the stator 7 opposite to the heat sink 11.

The impeller 12 includes a hollow hub 13, from which there extends a plurality of outer vanes 14. Radially outermost ends of the outer vanes 14 are joined to a ring 15 which extends in the proximity of the outer frame 3 of the support structure 2.

The hub 13 of the impeller 12 has an annular front wall 13*a* (see FIGS. 3-5 and 7 in particular) intended to be struck by the air flow caused by the impeller 12.

The hub 13 also has an essentially cylindrical side wall 13*b* which surrounds the electric motor 6. An annular space 16 is defined between the side wall 13*b* and the motor 6 (FIG. 7).

The hub 13 of the impeller 12 is further provided with a plurality of inner ventilation vanes 17 (FIGS. 3 to 5, 7 and 8) which extend from the inner surface thereof. Specifically, each inner ventilation vane 17 extends inwardly from the inner surface of the side wall 13*b* and is connected to the front wall 13*a* at its top end.

The inner ventilation vanes 17 are adapted to generate, in operation, within the annular space 16, a flow of cooling air which contacts the electric motor 6 and the heat sink 11.

In the front wall 13*a* of the hub 13 of the impeller 12, there is provided a plurality of intake openings 13*c*, for the inlet of respective air flows towards the annular space 16. These openings 13*c* are spaced apart angularly, and every two openings are separated from each other by the top end of an inner ventilation vane 17 (FIGS. 3 and 4).

Figure 5:
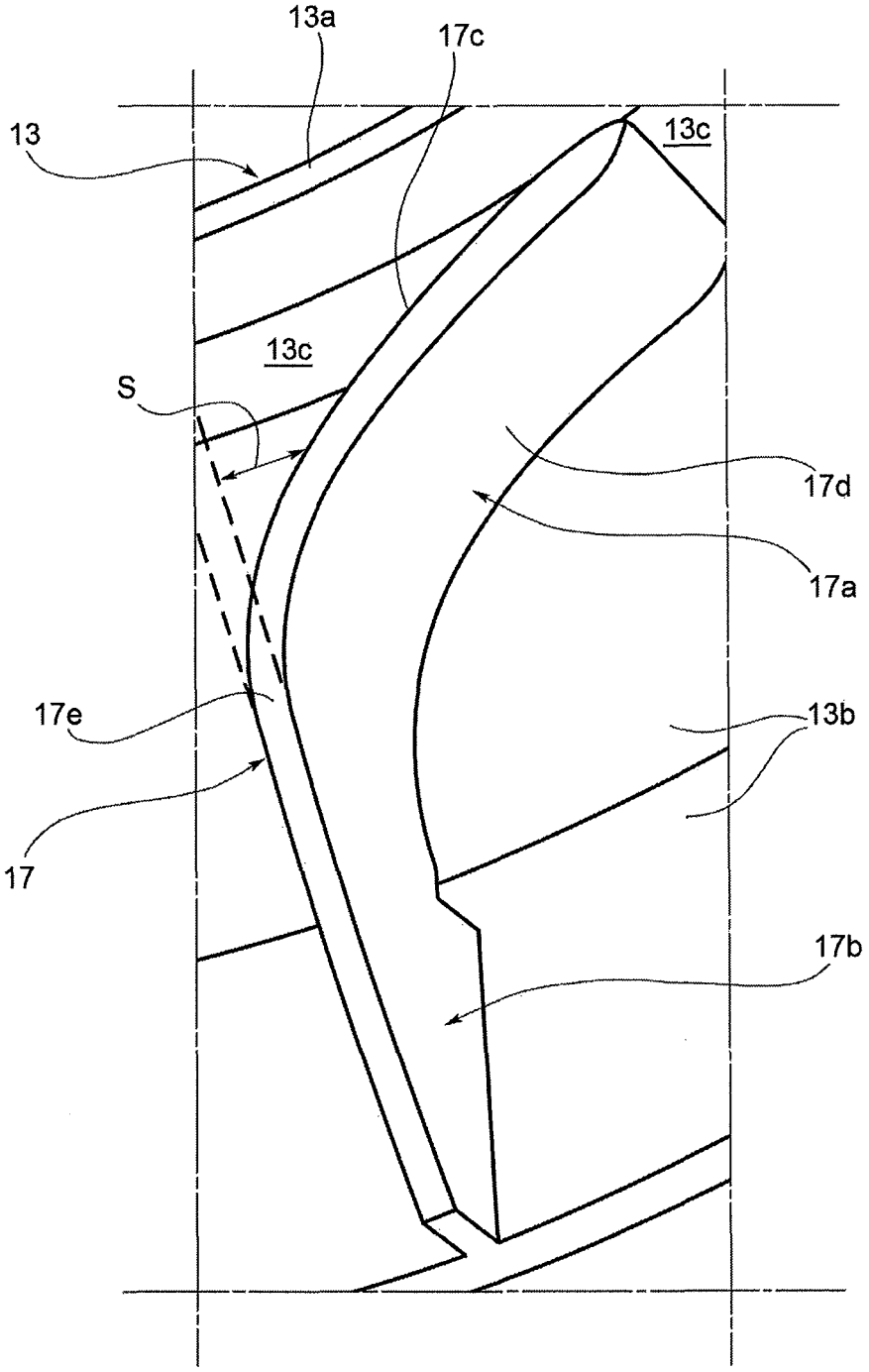
FIG. 5 is a partial perspective view showing, on a magnified scale, a detail indicated by V in FIG. 4.

Although in the above descriptions, the intake openings 13*c* had been described as if they are formed within the front wall, the intake openings, in fact, can be considered to be provided between the front wall 13*a* and the side wall 13*b*. That is, the side wall 13*b* surrounds and is spaced form a circumferential edge of the front wall 13*a*, and the top ends of the plurality of inner ventilation vanes 17 connect the side wall 13*b* to the front wall 13*a*. The top ends of the plurality of inner ventilation vanes 17 are spaced from each other angularly with an intake opening defined between the top ends of two adjacent inner vanes 17. With particular reference to FIG. 5, each inner ventilation vane 17 extends from the inner surface of the side wall 13*b* of the hub 13, and has a shape such as to generate an essentially axial air flow which is propagated into, and emerges from the rear of, the annular space 16.

Figure 3:
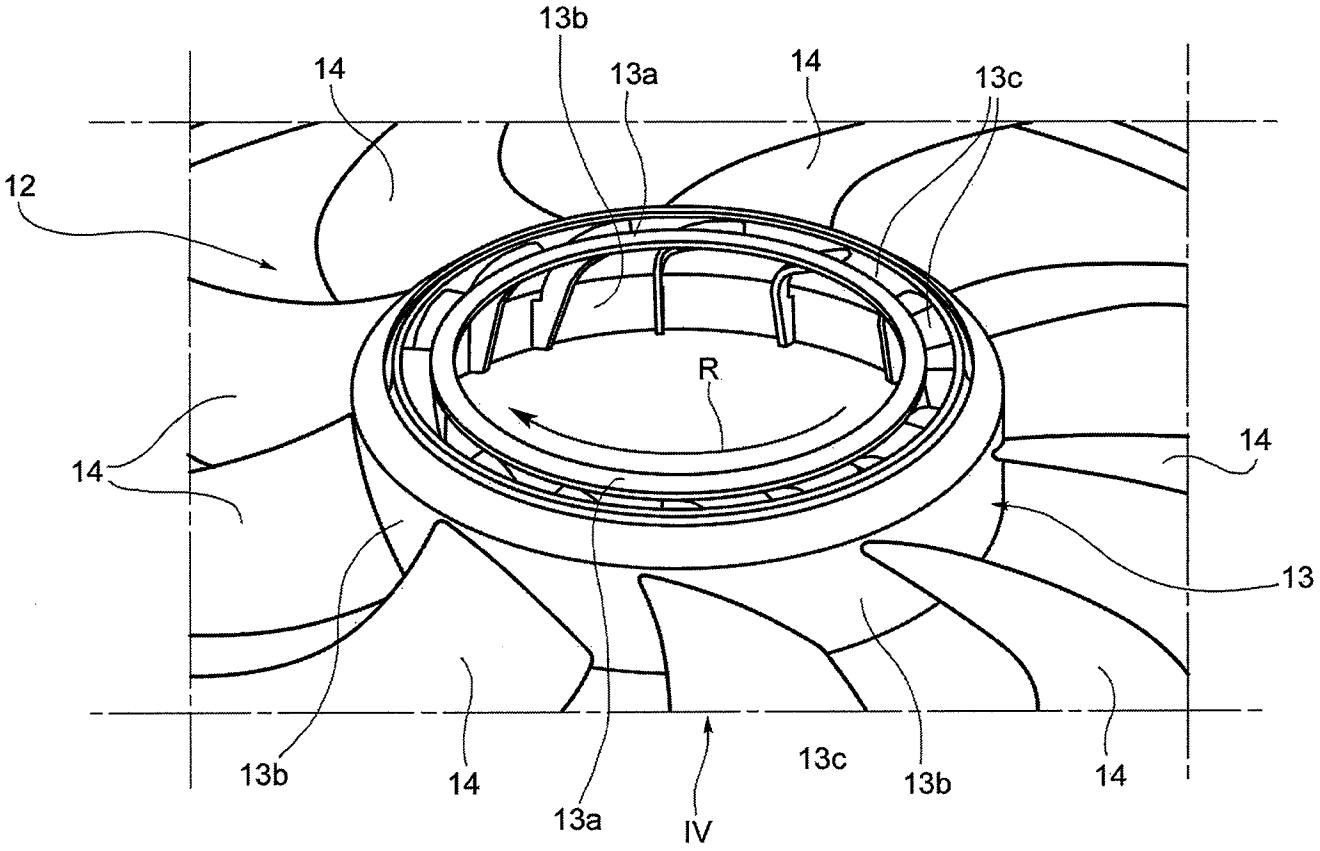
FIG. 3 is a partial perspective view which shows, on an enlarged scale, part of FIG. 1, indicated therein by III.
Figure 4:
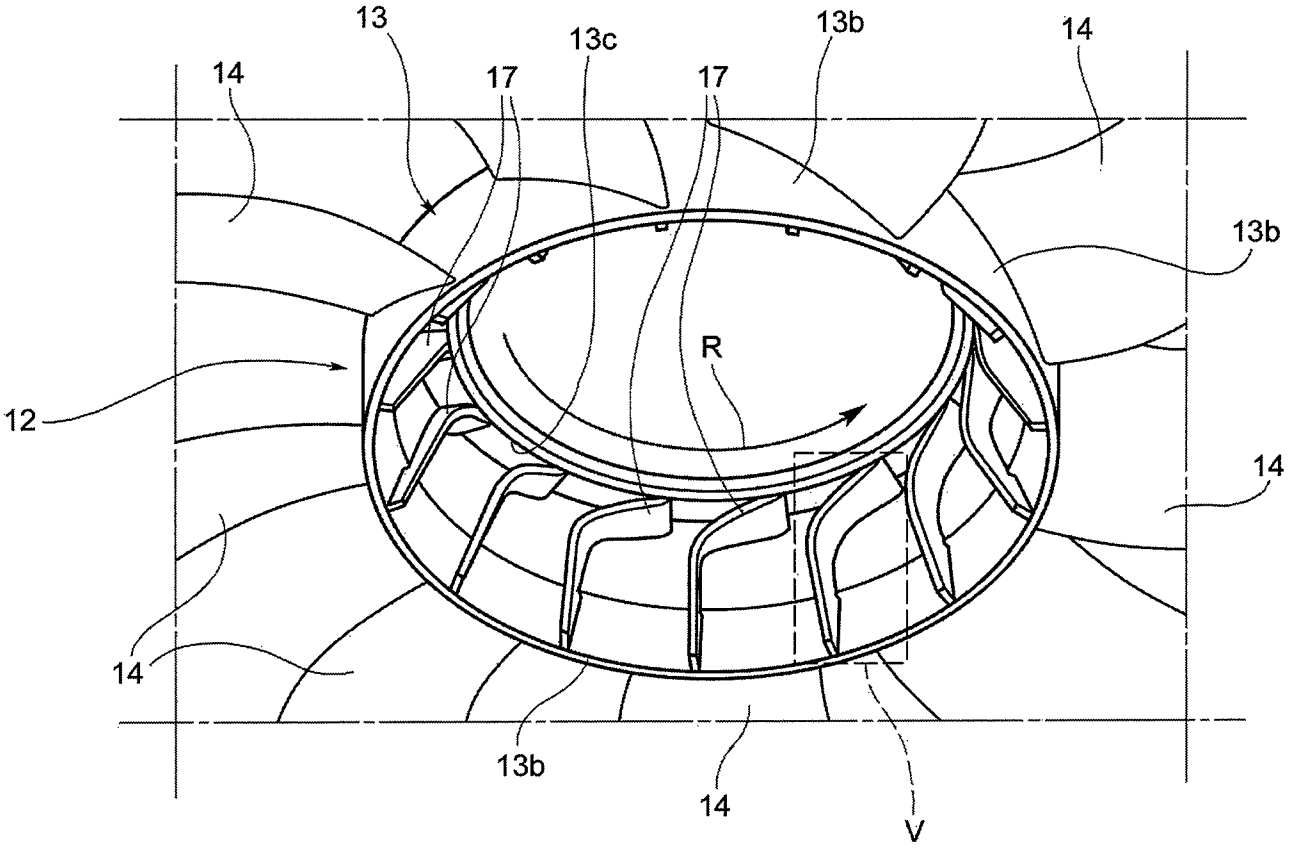
FIG. 4 is a partial perspective view taken in the direction of the arrow IV in FIG. 3.

In the embodiment specifically illustrated here, each inner ventilation vane 17 has an inlet portion 17*a* inclined forwards in a rotation direction of the impeller 12 (indicated by the curved arrows R in FIGS. 3 and 4). The inlet portion 17*a* of each vane 17 is joined continuously to an essentially radial outlet portion 17*b*, which extends essentially up to the rear edge of the side wall 13*b* of the hub 13.

As shown in FIG. 5, the inlet portion 17*a* of each inner ventilation vane 17 has, in a direction extending from the corresponding outlet portion 17*b* towards the front wall 13*a* of the hub 13, a circumferential offset S which increases with respect to the axial prolongation of the outlet portion 17*b*, shown in broken lines in FIG. 5. In other words, the inlet portion 17*a* of each inner ventilation vane 17 has a circumferential deviation from and increasing along an axial prolongation of the outlet portion 17*b*.

Conveniently, the inlet portion 17*a* of each inner ventilation vane 17 is arcuate and has a convex outer surface 17*c*, facing the front wall 13*a* of the hub 13, and an essentially concave inner surface 17*d*, facing in the opposite direction.

Again with reference to FIG. 5, when seen in the radial direction, the inlet portion 17*a* of each ventilation vane 17 has a cross section shaped like a wing profile.

With reference to FIGS. 7 and 8, on the opposite side to the side wall 13*b* of the hub 13, each inner ventilation vane 17 has, overall, a free longitudinal edge 17*e*, which is arcuate and convex.

Figure 6:
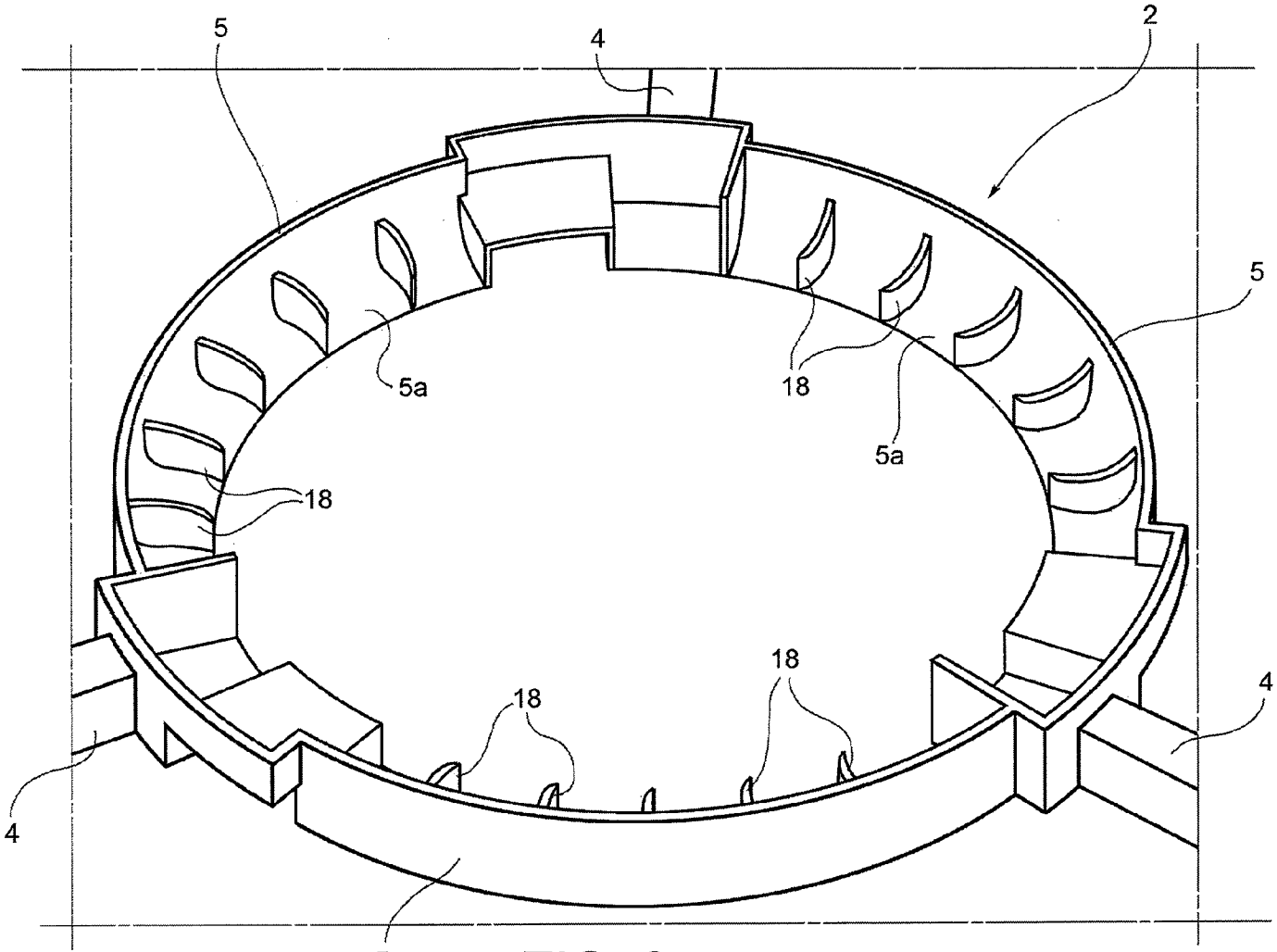
FIG. 6 is a partial perspective view showing an annular inner seat of the support structure of the fan module according to the preceding drawings.

Advantageously, the inner seat 5 of the support structure 2 forms an inner deflection surface, indicated by 5*a* in FIGS. 6 to 8, which faces the rear end edge of the hub 13 of the impeller 12. An axial middle portion of the inner deflection surface 5*a* is inclined with respect to the rotation axis A-A of the motor 6, and preferably curved and concave in cross section. As such, the inner deflection surface 5*a* of the inner seat 5 is adapted to divert, in a centripetal radial direction, towards the heat sink 11 associated with the control circuit 9, at least part of the axial air flow exiting from the annular space 16 formed between the motor 6 and the hub 13 of the impeller 12 (FIGS. 7 and 8).

Conveniently, a plurality of essentially radial ribs 18 extend from the inner surface 5*a* of the inner seat 5 of the support structure 2.

In the embodiment illustrated in FIG. 7, on the side facing the side wall 13*b* of the hub 13 of the impeller 12, the inner seat 5 of the support structure 2 has a mouth opening 5*b* with a diameter which is greater than an outlet diameter of the side wall 13*b* of the impeller 12. Because of this shape, it is also possible for an essentially axial air flow to penetrate into the inner seat 5, this air flow contacting the outer lateral surface of the hub 13. This flow is also deflected, essentially in a centripetal radial direction, towards the heat sink 11.

In another embodiment illustrated in FIG. 8, the mouth opening 5*b* of the inner seat 5 has a diameter which is substantially equal to the outlet diameter of the side wall 13*b* of the hub 13. In this embodiment, the radial extension of the annular space 16 formed between the electric motor 6 and the side wall of the hub 13 can be increased if necessary.

Clearly, provided that the principle of the invention is retained, the forms of application and the details of embodiment can be varied widely from what has been described and illustrated purely by way of non-limiting example, without thereby departing from the scope of protection of the invention as defined by the attached claims.

In the description and claims of the present application, each of the verbs "comprise", "include", "contain" and "have", and variations thereof, are used in an inclusive sense, to specify the presence of the stated item but not to exclude the presence of additional items.

The invention claimed is:

1. A fan module comprising:
- a support structure comprising:
  - an outer frame;
  - an inner seat; and
  - a plurality of spokes connecting the outer frame to the inner seat;
- an electric motor comprising:
  - a stator having a first end fixed to the inner seat of the support structure and a second end opposite to the first end;
  - a rotor rotatably mounted to the stator;
  - a heat sink located at the first end of the stator; and
  - a motor control circuit having components in thermal contact with the heat sink; and
- an impeller fixed to the rotor of the motor at the second end of the stator, the impeller comprising:
  - a hub having:
    - a front wall fixed to an end of the rotor remote from the inner seat of the support structure;
    - a side wall surrounding and spaced from a circumferential edge of the front wall; and
    - a plurality of inner vanes extending inwardly from an inner surface of the side wall, having top ends connected to the front wall, and spaced apart from each other angularly with an intake opening defined between the top ends of two adjacent inner vanes; and a plurality of outer vanes extending from an outer periphery of the side wall of the hub.

2. The fan module of claim 1, wherein the inner seat of the support structure has an inner deflection surface facing an end edge of the side wall of the hub of the impeller, and at least a portion of the inner deflection surface is inclined with respect to a rotation axis of the motor.

3. The fan module of claim 2, wherein the at least a portion of the inner deflection surface of the inner seat is curved in cross section.

4. The fan module of claim 2, wherein a plurality of ribs extend essentially radially from the inner deflection surface of the inner seat of the support structure.

5. The fan module of claim 2, wherein, on the side facing the side wall of the hub of the impeller, the inner seat of the support structure has a mouth opening defined by the inner deflection surface and having a diameter not less than an outlet diameter of the side wall.

6. The fan module of claim 1, wherein each inner vane has an inlet portion adjacent to the front wall of the hub and an outlet portion extending essentially radially and axially, the inlet portion is inclined forwardly in a direction of rotation of the impeller, and has a circumferential deviation from and along an axial prolongation of the outlet portion.

7. The fan module of claim 6, wherein the inlet portion of each inner vane is arcuate and has a convex outer surface, facing the front wall of the hub of the impeller, and an essentially concave inner surface, facing in the opposite direction.

8. The fan module of claim 7, wherein the inlet portion of each inner vane has, when seen in the radial direction, a cross section shaped like a wing profile.

9. The fan module of claim 1, wherein each inner vane has a free longitudinal edge on a side opposite to the side wall, and the free longitudinal edge is arcuate and convex.

10. The fan module of claim 1, wherein the intake openings are formed in the front wall or formed between the front wall and the side wall.

11. A fan module comprising:
- a support structure having an outer frame, an inner seat, and a plurality of spokes connecting the outer frame to the inner seat;
- an electric motor having a stator fixed to the support structure and a rotor rotatably mounted to the stator; and
- an impeller fixed to the rotor of the motor, the impeller comprising:
- a hub having:
  - a front wall defining a plurality of intake openings;
  - a side wall surrounding the motor, with a space defined between the side wall and the motor;
  - a plurality of inner vanes extending from an inner surface of the side wall of the hub, each inner vane having an inlet portion adjacent to the front wall and an outlet portion extending essentially radially and axially from the inlet portion, wherein the inlet portion is inclined forwardly with respect to the outlet portion in a direction of rotation of the impeller, and has a circumferential deviation from and increasing along an axial prolongation of the outlet portion; and
  - a plurality of outer vanes extending from an outer periphery of the side wall of the hub.

12. The fan module of claim 11, wherein the inlet portion of each inner vane has, when seen in the radial direction, a cross section shaped like a wing profile.

13. The fan module of claim 11, wherein the inlet portion of each inner vane is arcuate and has a convex outer surface, facing the front wall of the hub of the impeller, and an essentially concave inner surface, facing in the opposite direction.

14. The fan module of claim 11, wherein each inner vane has a free longitudinal edge on a side opposite to the side wall, and the free longitudinal edge is arcuate and convex.

15. The fan module of claim 11, wherein each of the inner vane has a top end connected to the front wall, the plurality of intake openings are angularly separated from each other by top ends of the inner vanes.

16. The fan module of claim 11, wherein the inner seat of the support structure has an inner deflection surface facing an end edge of the side wall of the hub of the impeller, and at least a portion of the inner deflection surface is inclined with respect to a rotation axis of the motor.

17. The fan module of claim 16, wherein the at least a portion of the inner deflection surface of the inner seat is curved in cross section.

18. The fan module of claim 16, wherein a plurality of essentially radial ribs extend from the inner deflection surface of the inner seat of the support structure.

19. The fan module of claim 16, wherein, on the side facing the side wall of the hub of the impeller, the inner seat of the support structure has a mouth opening defined by the inner deflection surface and having a diameter not less than an outlet diameter of the side wall.

* * * * *